US012735960B2

(12) United States Patent
Zhang et al.

(10) Patent No.: US 12,735,960 B2
(45) Date of Patent: Sep. 15, 2026

(54) REAR-MOUNTED DOUBLE-CHANNEL ABRASIVE JET CUTTING DEVICE

(71) Applicant: CCTEG CHONGQING RESEARCH INSTITUTE, Chongqing (CN)

(72) Inventors: Yongjiang Zhang, Chongqing (CN); Lindong Guo, Chongqing (CN); Xusheng Zhao, Chongqing (CN); Haitao Sun, Chongqing (CN); Jianjun Cao, Chongqing (CN); Chengcheng Li, Chongqing (CN); Zhanjin Lu, Chongqing (CN); Zhenfei Huang, Chongqing (CN); Fei Ji, Chongqing (CN); Zunyu Xu, Chongqing (CN); Junjian Xu, Chongqing (CN); Shuai Li, Chongqing (CN); Xingang Niu, Chongqing (CN); Huiming Yang, Chongqing (CN); Zhonghua Wang, Chongqing (CN); Yongsan Liu, Chongqing (CN); Huaifu Liu, Chongqing (CN)

(73) Assignee: CCTEG Chongqing Research Institute, Chongqing (CN)

( * ) Notice: Subject to any disclaimer, the term of this patent is extended or adjusted under 35 U.S.C. 154(b) by 226 days.

(21) Appl. No.: 18/555,527

(22) PCT Filed: Nov. 3, 2021

(86) PCT No.: PCT/CN2021/128316

§ 371 (c)(1),
(2) Date: Apr. 25, 2025

(87) PCT Pub. No.: WO2023/060668

PCT Pub. Date: Apr. 20, 2023

(65) Prior Publication Data

US 2026/0028900 A1 Jan. 29, 2026

(30) Foreign Application Priority Data

Oct. 13, 2021 (CN) ..... 202111192668.7

(51) Int. Cl.
*E21B 43/114* (2006.01)
*B24C 7/00* (2006.01)
*E21B 7/18* (2006.01)

(52) U.S. Cl.
CPC ..... *E21B 43/114* (2013.01); *E21B 7/18* (2013.01); *B24C 7/0076* (2013.01)

(58) Field of Classification Search
CPC ..... E21B 43/114; E21B 7/18; B24C 7/0076
See application file for complete search history.

(56) References Cited

U.S. PATENT DOCUMENTS 4,534,427 A * 8/1985 Wang ..... B24C 3/325 175/70
4,854,091 A * 8/1989 Hashish ..... B24C 5/02 451/38

(Continued)

FOREIGN PATENT DOCUMENTS

CN 203655346 U * 6/2014
CN 212317853 U * 1/2021

OTHER PUBLICATIONS

PE2E Translation—CN203655346 (Year: 2014).*

*Primary Examiner* — Tara Schimpf
*Assistant Examiner* — Daniel T Craig
(74) *Attorney, Agent, or Firm* — Wang Law Firm, Inc.

(57) ABSTRACT

The present invention relates to a rear-mounted double-channel abrasive jet cutting device, falling within the field of coal seam pressure relief and permeability improvement. It primarily comprises an ultra-high pressure clean water pump, an ultra-high pressure hose, an ultra-high pressure rotary water swivel, an abrasive pumping device, an abra- (Continued)

sive rotary sealing water swivel, a double-channel sealing drill pipe, and a double-channel cutter. High-pressure water and abrasive are conveyed through two independent channels, thereby avoiding the wear caused to the high-pressure hoses and drilling tools by mixed conveyance, whilst also preventing linear pressure loss in the high-pressure water. This structure effectively improves the coal-breaking performance of high-pressure water jet cutting and extends the service life of the cutting apparatus.

7 Claims, 2 Drawing Sheets

(56) References Cited

U.S. PATENT DOCUMENTS

| | | | | |
|---|---|---|---|---|
| 8,925,653 | B2 * | 1/2015 | Dotson | E21B 43/114<br>166/222 |
| 11,448,027 | B2 * | 9/2022 | Al Daif | E21B 43/27 |

* cited by examiner

REAR-MOUNTED DOUBLE-CHANNEL ABRASIVE JET CUTTING DEVICE

FIELD OF INVENTION

The present invention belongs to the field of coal seam pressure relief and permeability improvement, and relates to a rear-mounted double-channel abrasive jet cutting device.

BACKGROUND ART OF THE INVENTION

Coal seam pressure relief and permeability improvement is one of the effective means for coal-gas dynamic disaster prevention and control. In recent years, with the development of coal mine disaster prevention technology and equipment, hydraulic measures have become one of the main technical means for coal seam pressure relief and permeability improvement. In particular, hydraulic cutting technology has a strong coal breaking capacity and a wide range of effective pressure relief, which has been widely used. However, as mining depth of a coal mine is increased, and influenced by factors such as increase of in-situ stress and increase of coal firmness coefficient, the coal breaking capacity of water jet cutting is decreased, which seriously restricts the influence range of pressure relief by water jet cutting.

In recent years, in order to improve the influence range of water jet cutting, abrasive is added to high pressure water to increase the hitting force of a water jet and increase the cutting radius of the water jet. At present, for most of the existing abrasive jet sand adding devices, an abrasive tank is equipped in the middle part of a high pressure transfer pipeline, and abrasive is brought to a high pressure water transfer pipeline to be mixed and transferred by kinetic energy in a process of high pressure water transfer, and ejected together at a nozzle to cut a coal seam so as to increase the cutting depth. However, in the above abrasive jet sand adding devices, the abrasive and the high pressure water are mixed in the same transfer pipeline to be transferred, therefore wear of main components such as a high pressure hose, a water swivel, a drill pipe and a cutter is increased under the action of the high pressure water, which seriously influences the service life of the devices and brings safety risks to on-site operators. Therefore, it is urgent to develop an abrasive jet cutting device which supplies high pressure water and abrasive through double channels, and avoids wear of a high pressure transfer pipeline caused by abrasive during transfer, thus to prolong the service life of the device.

DISCLOSURE OF THE INVENTION

In view of this, aiming at the problem that a coal mine abrasive jet cutting device has heavy wear on a drilling tool, short service life and serious linear pressure loss, the purpose of the present invention is to provide a rear-mounted double-channel abrasive jet cutting device which realizes double-channel transfer of high pressure water and abrasive, and avoids wear of a high pressure transfer pipeline and the drilling tool caused by the abrasive under the action of the high pressure water, thus to prolong the service life of the device.

To achieve the above purpose, the present invention provides the following technical solution:

A rear-mounted double-channel abrasive jet cutting device, comprising an ultra-high pressure water jet supply system and an abrasive supply system, wherein the ultra-high pressure water jet supply system is used to provide a continuous high pressure water jet power source, abrasive transfer is provided by the abrasive supply system, and cutting is performed by a high pressure abrasive jet formed by mixing abrasive into the water jet power source, thus to enhance a hitting force for cutting.

Optionally, the ultra-high pressure water jet supply system comprises an ultra-high pressure clean water pump and an ultra-high pressure rotary water swivel connected by an ultra-high pressure hose.

Optionally, the abrasive supply system comprises an abrasive tank and a feeding pump which are in communication with each other, a pressure cap is arranged on the abrasive tank, the abrasive tank is connected with an abrasive transfer hose, and one end of the abrasive transfer hose away from the abrasive tank is provided with an abrasive rotary sealing water swivel.

Optionally, the abrasive rotary sealing water swivel comprises a water swivel outer wall, wherein the water swivel outer wall is internally divided into a water swivel high pressure water channel and a water swivel abrasive channel by a water swivel inner wall, a sealing rotary body outer bayonet is arranged on the water swivel outer wall, a sealing rotary body is arranged in the sealing rotary body outer bayonet through sealing bearings, abrasive feeding holes in communication with the water swivel abrasive channel are formed in the sealing rotary body outer bayonet, and water swivel abrasive transfer holes are formed in one end of the water swivel abrasive channel.

Optionally, six abrasive feeding holes are symmetrically distributed in the water swivel inner wall.

Optionally, the abrasive and the water jet power source are mixed by the ultra-high pressure water jet supply system and the abrasive supply system through a double-channel sealing drill pipe; the double-channel sealing drill pipe comprises a drill pipe outer wall, and the drill pipe outer wall is internally divided into a drill pipe abrasive channel in communication with the abrasive supply system and a drill pipe high pressure water channel in communication with the ultra-high pressure water jet supply system by a drill pipe inner wall; drill pipe abrasive transfer holes are formed in one end of the drill pipe abrasive channel.

Optionally, cutting is performed by the ultra-high pressure water jet supply system and the abrasive supply system through a double-channel cutter, wherein the double-channel cutter comprises a cutter outer wall, and the cutter outer wall is internally divided into a cutter abrasive channel and a cutter high pressure water channel by a cutter inner wall; cutter abrasive transfer holes are formed in one end of the cutter abrasive channel, a nozzle penetrating through the cutter abrasive channel is arranged on the cutter high pressure water channel, nozzle abrasive transfer holes are formed in one end of the nozzle inside the cutter high pressure water channel, and a nozzle hole is formed in one end of the nozzle on the cutter outer wall.

Optionally, one end of the cutter high pressure water channel is provided with a pressure relief baffle, and the pressure relief baffle is arranged in the cutter high pressure water channel through a spring.

Optionally, four cutter abrasive transfer holes are annularly and symmetrically distributed at a junction between the cutter outer wall and the cutter inner wall.

Optionally, two nozzle abrasive transfer holes are symmetrically distributed in the nozzle.

The present invention has the following beneficial effects:

The present invention provides a rear-mounted double-channel abrasive jet cutting device and a use method, and realizes double-channel supply of ultra-high pressure water and abrasive sand of the high pressure abrasive jet by innovatively inventing the main components such as the abrasive tank, the feeding pump, the pressure cap, the abrasive transfer hose, the abrasive rotary sealing water swivel, the double-channel sealing drill pipe and the double-channel cutter. Compared with a traditional abrasive jet device, the present invention avoids the wear of the high pressure hose and the drilling tool caused by the abrasive sand during transfer in the high pressure water transfer pipeline, and prolongs the service life. At the same time, the linear pressure loss of the high pressure water is avoided, which increases the impact force of the abrasive jet, improves the coal breaking capacity, and increases the cutting radius. Pressure and mixing ratio of the abrasive jet can be controlled flexibly by adjusting pressure of the ultra-high pressure clean water pump and the feeding pump, which is convenient for on-site staff to control the cutting effect. Abrasive supply is realized by pressurization with the feeding pump, which can effectively avoid the phenomenon that the holes are blocked by the abrasive. The use method of the rear-mounted double-channel abrasive jet cutting device provided by the present invention simplifies the traditional abrasive jet operation process, reduces the labor intensity of the staff, and thus has a high on-site promotion value.

Other advantages, objectives and features of the present invention will be illustrated in the following description to some extent, and will be apparent to those skilled in the art based on the following investigation and research to some extent, or can be taught from the practice of the present invention. The objectives and other advantages of the present invention can be realized and obtained through the following description.

DESCRIPTION OF THE DRAWINGS

To enable the purpose, the technical solution and the advantages of the present invention to be more clear, the present invention will be preferably described in detail below in combination with the drawings, wherein.

Figure 1:
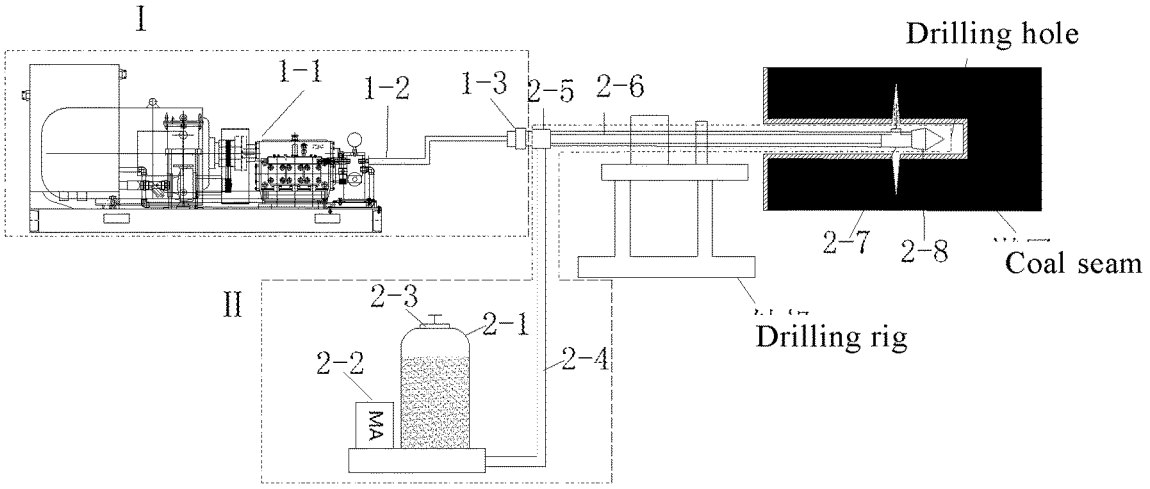
FIG. 1 is a structural schematic diagram of a device of the present invention.

Reference signs: ultra-high pressure clean water pump 1-1; ultra-high pressure hose 1-2; ultra-high pressure rotary water swivel 1-3; abrasive tank 2-1; feeding pump 2-2; pressure cap 2-3; abrasive transfer hose 2-4; abrasive rotary sealing water swivel 2-5; double-channel sealing drill pipe 2-6; double-channel cutter 2-7; drill bit 2-8; water swivel outer wall 2-5*a*; water swivel inner wall 2-5*b*; sealing rotary body 2-5*c*; sealing rotary body outer bayonet 2-5*d*; sealing bearing 2-5*e*; abrasive feeding hole 2-5*f*; water swivel abrasive transfer hole 2-5*g*; water swivel abrasive channel 2-5*h*; water swivel high pressure water channel 2-5*i*; drill pipe outer wall 2-6*a*; drill pipe inner wall 2-6*b*; drill pipe abrasive channel 2-6*c*; drill pipe abrasive transfer hole 2-6*d*; drill pipe high pressure water channel 2-6*e*; cutter outer wall 2-7*a*; cutter inner wall 2-7*b*; cutter abrasive channel 2-7*c*; cutter abrasive transfer hole 2-7*d*; nozzle 2-7*e*; nozzle hole 2-7*f*; nozzle abrasive transfer hole 2-7*g*; cutter high pressure water channel 2-7*h*; spring 2-7*i*; pressure relief baffle 2-7*j*.

DETAILED DESCRIPTION OF THE INVENTION

Embodiments of the present invention are described below through specific embodiments. Those skilled in the art can understand other advantages and effects of the present invention easily through the disclosure of the description. The present invention can also be implemented or applied through additional different specific embodiments. All details in the description can be modified or changed based on different perspectives and applications without departing from the spirit of the present invention. It should be noted that the figures provided in the following embodiments only exemplarily explain the basic conception of the present invention, and if there is no conflict, the following embodiments and the features in the embodiments can be mutually combined.

Wherein the drawings are only used for exemplary description, are only schematic diagrams rather than physical diagrams, and shall not be understood as a limitation to the present invention. In order to better illustrate the embodiments of the present invention, some components in the drawings may be omitted, scaled up or scaled down, and do not reflect actual product sizes. It should be understandable for those skilled in the art that some well-known structures and description thereof in the drawings may be omitted.

Same or similar reference signs in the drawings of the embodiments of the present invention refer to same or similar components. It should be understood in the description of the present invention that terms such as "upper", "lower", "left", "right", "front" and "back" indicate direction or position relationships shown based on the drawings, and are only intended to facilitate the description of the present invention and the simplification of the description rather than to indicate or imply that the indicated device or element must have a specific direction or constructed and operated in a specific direction, and therefore, the terms describing position relationships in the drawings are only used for exemplary description and shall not be understood as a limitation to the present invention; for those ordinary skilled in the art, the meanings of the above terms may be understood according to specific conditions.

Figure 2:
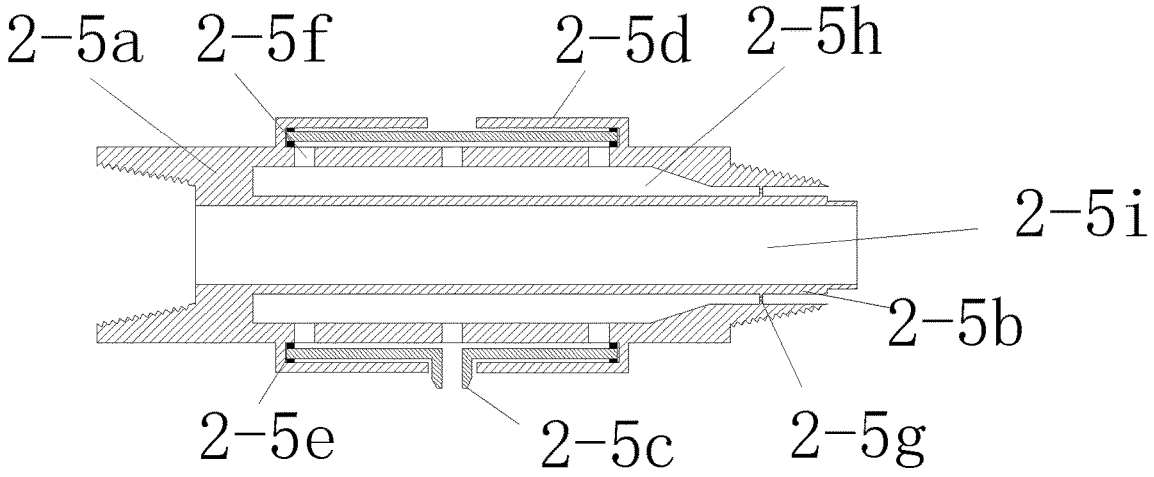
FIG. 2 is a structural schematic diagram of an abrasive rotary sealing water swivel.
Figure 3:
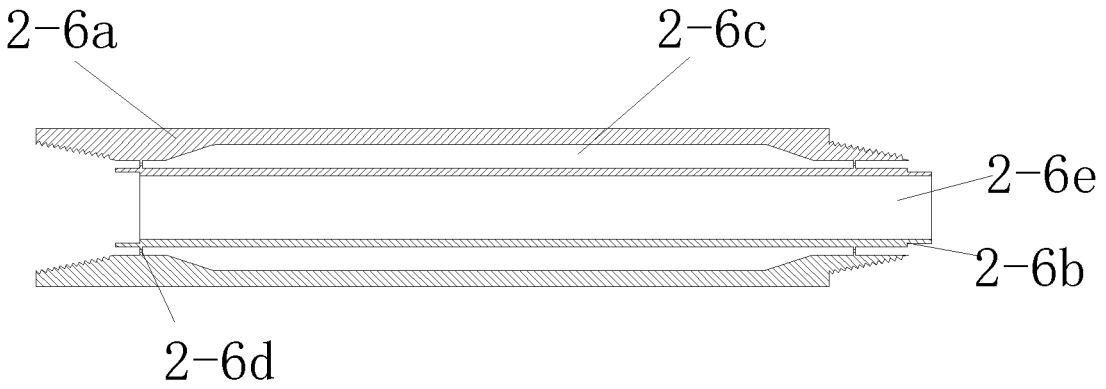
FIG. 3 is a structural schematic diagram of a double-channel sealing drill pipe.
Figure 4:
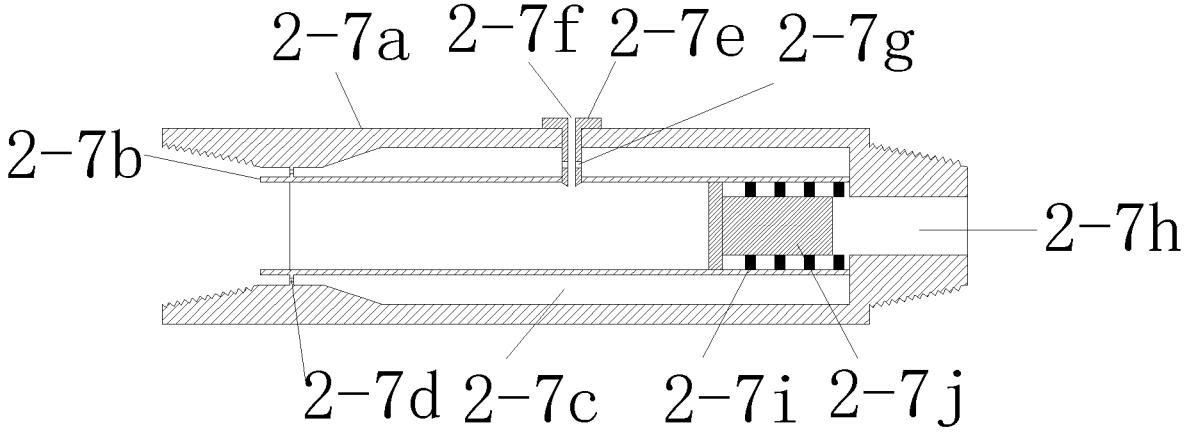
FIG. 4 is a structural schematic diagram of a double-channel cutter in a jet condition.

As shown in FIG. 1 to FIG. 4, a rear-mounted double-channel abrasive jet cutting device is disclosed, which can realize double-channel separate transfer of high pressure water and abrasive, and can avoid problems such as heavy wear of a high pressure transfer pipeline caused by a mixed transfer process. The present invention mainly comprises an ultra-high pressure water jet supply system I and an abrasive supply system II. A continuous water jet power source is provided by the ultra-high pressure water jet supply system I, abrasive transfer is provided by the abrasive supply system II, and a high pressure abrasive jet is formed by mixing at the front end of a cutter, thus to enhance a hitting force of a water jet. The ultra-high pressure water jet supply system I comprises an ultra-high pressure clean water pump 1-1, an ultra-high pressure hose 1-2 and an ultra-high pressure rotary water swivel 1-3, wherein the ultra-high pressure clean water pump 1-1 is matched and in communication with the ultra-high pressure rotary water swivel 1-3 by the ultra-high pressure hose 1-2; The abrasive supply system II comprises an abrasive tank 2-1, a feeding pump 2-2, a pressure cap 2-3, an abrasive transfer hose 2-4 and an abrasive rotary sealing water swivel 2-5, wherein the abrasive tank 2-1 is matched and in communication with the abrasive rotary sealing water swivel 2-5 by the abrasive transfer hose 2-4; the ultra-high pressure rotary water swivel 1-3 is matched and in communication with the abrasive rotary sealing water swivel 2-5; a double-channel sealing drill pipe 2-6, a double-channel cutter 2-7 and a drill bit 2-8 are matched and connected in sequence on one side away from the ultra-high pressure clean water pump and installed on a drilling rig.

High pressure water of 100 MPa can be provided by the ultra-high pressure clean water pump 1-1, bearing pressure of the ultra-high pressure hose 1-2 is ≥160 MPa, and bearing pressure of the ultra-high pressure rotary water swivel 1-3 is ≥160 Mpa; the abrasive tank 2-1 has a volume of ≤100 L, a ratio of height to diameter of 6:1 and a bearing pressure of 30 MPa. The feeding pump 2-2 has a power of 5 KW and a pumping pressure of 15 MPa. The abrasive transfer hose 2-4 is a steel wire spiraled rubber hose with a pipe diameter of 32 mm and a bearing pressure of 30 MPa; particle size of the abrasive sand is ≤80 meshes, and sand-to-water ratio of the mixture in the abrasive tank is 2:1; the abrasive rotary sealing water swivel can realize rotary dynamic sealing of the abrasive sand, and has a bearing pressure of ≥160 MPa.

The structure of the abrasive rotary sealing water swivel comprises a water swivel outer wall 2-5*a*, a water swivel inner wall 2-5*b*, a sealing rotary body 2-5*c*, a sealing rotary body outer bayonet 2-5*d*, sealing bearings 2-5*e*, an abrasive feeding hole 2-5*f*, a water swivel abrasive transfer hole 2-5*g* and a water swivel abrasive channel 2-5*h*. Sealing bearings 2-5*e* are installed on both ends of the sealing rotary body 2-5*c* which is embedded between the water swivel outer wall 2-5*a* and the sealing rotary body outer bayonet 2-5*d*. Six abrasive feeding holes 2-5*f* are symmetrically distributed in both sides of the water swivel inner wall 2-5*b*, the diameter of each hole is 10 mm, and the distance between holes is 100 mm. Four water swivel abrasive transfer holes 2-5*g* are annularly and symmetrically distributed at a junction between the water swivel outer wall 2-5*a* and the water swivel inner wall 2-5*b*, and the diameter of each hole is 5 mm.

The structure of the double-channel sealing drill pipe comprises a pipe outer wall 2-6*a*, a drill pipe inner wall 2-6*b*, a drill pipe abrasive channel 2-6*c*, drill pipe abrasive transfer holes 2-6*d* and a drill pipe high pressure water channel 2-6*e*. Four drill pipe abrasive transfer holes 2-6*d* are annularly and symmetrically distributed at a junction between the drill pipe outer wall 2-6*a* and the drill pipe inner wall 2-6*b*, and the diameter of each hole is 5 mm. The double-channel sealing drill pipe can realize double-channel sealing transfer of the abrasive and the high pressure water, and has a bearing pressure of ≥120 MPa.

The double-channel cutter is provided with an abrasive transfer channel and a high pressure water transfer channel, and the high pressure water transfer channel has a function of water jet high and low pressure conversion. In a high pressure jet condition, and under an abrasive pumping action and a siphon action of the high pressure water, the abrasive is ejected together with a high pressure water jet to form the abrasive jet;

The structure of the double-channel cutter comprises a cutter outer wall 2-7*a*, a cutter inner wall 2-7*b*, a cutter abrasive channel 2-7*c*, a cutter abrasive transfer hole 2-7*d*, a nozzle 2-7*e*, a nozzle hole 2-7*f*, nozzle abrasive transfer holes 2-7*g*, a cutter high pressure water channel 2-7*h*, a spring 2-7*i* and a pressure relief baffle 2-7*j*. Four cutter abrasive transfer holes 2-7*d* are annularly and symmetrically distributed at a junction between the cutter outer wall 2-7*a* and the cutter inner wall 2-7*b*, and the diameter of each hole is 5 mm. A high and low pressure conversion control valve is formed by the spring 2-7*i* and the pressure relief baffle 2-7*j*, and the conversion value is 15 MPa. The nozzle 2-7*e* has the nozzle hole 2-7*f* and the nozzle abrasive transfer holes 2-7*g*, and the diameter of the nozzle hole 2-7*f* can be 2.5 mm; two nozzle abrasive transfer holes 2-7*g* are symmetrically distributed in a column of the nozzle 2-7*e*, and the diameter of each hole is 5 mm.

The high and low pressure conversion control valve is formed by the spring 2-7*i* and the pressure relief baffle 2-7*j*, a high and low pressure conversion threshold can be set by selecting springs of different specifications, and the conversion threshold can be 10 MPa, 15 MPa or 20 Mpa. When supplied water pressure is lower than the high and low pressure conversion threshold, the pressure relief baffle 2-7*j* is located at the rear end of the cutter, and water flows out from the front end. When the water pressure is higher than the threshold, the pressure relief baffle 2-7*j* is pushed to the front end, the water flowing out from the front end is cut off, and all the water are ejected from the nozzle 2-7*e* to form a high pressure jet. The nozzle 2-7*e* has the nozzle hole 2-7*f* and the nozzle abrasive transfer holes 2-7*g*, and the diameter of the nozzle hole 2-7*f* can be 2.5 mm, 3.0 mm or 3.5 mm. Two nozzle abrasive transfer holes 2-7*g* are symmetrically distributed in a column of the nozzle 2-7*e*, and the diameter of each hole is 5 mm.

A use method of the present invention comprises the following steps:

a. Hole drilling construction. Connecting the double-channel sealing drill pipe 2-6, the double-channel cutter 2-7 and the drill bit 2-8 in sequence, and using the drilling rig to perform atmospheric pressure water construction drilling to a designated position according to a design scheme of hole drilling construction, without retracting the drill pipe after the hole drilling construction is completed;

b. Device connection. Using the ultra-high pressure hose 1-2 to match and communicate the ultra-high pressure clean water pump 1-1 with the ultra-high pressure rotary water swivel 1-3; connecting the ultra-high pressure rotary water swivel 1-3 with the abrasive rotary sealing water swivel 2-5, and then installing the two on the double-channel sealing drill pipe 2-6; using the abrasive transfer hose 2-4 to match and communicate the abrasive rotary sealing water swivel 2-5 with the abrasive tank 2-1.

c. Cutting construction. First, opening the pressure cap 2-3 before abrasive jet cutting, adding abrasive sand and water to the abrasive tank 2-1 at a sand-to-water ratio of 2:1, and tightening the pressure cap 2-3 after the abrasive is fully filled. Then, starting the ultra-high pressure clean water pump 1-1, adjusting the pressure to 30 MPa to conduct a pressure adjusting test, and increasing the pressure slowly. After returned water at the opening of a hole is normal, starting the feeding pump and increasing the pressure to 15 MPa. After the pressure of the filling pump is stable, adjusting the pressure of the ultra-high pressure clean water pump 1-1 to 60-100 MPa to perform abrasive jet cutting, and keeping the pressure for 10-15 min. After single knife cutting is completed, turning off the feeding pump, reducing the pressure of the ultra-high pressure clean water pump 1-1 to 5 MPa, and keeping the pressure for 2-3 min. After returned water at the opening of a drilled hole is normal, turning off the ultra-high pressure clean water pump 1-1. Retracting the drill pipe from the hole, and following the above steps in sequence to complete hole drilling and cutting operations.

d. Device cleaning. After hole drilling and cutting are completed, injecting clean water into the abrasive tank 2-1 and tightening the pressure cap 2-3. Then, starting the feeding pump, increasing the pressure to 5 MPa and keeping the pressure for 2 min; cleaning the residual abrasive in the abrasive tank 2-1, the abrasive rotary sealing water swivel 2-5, the double-channel sealing drill pipe 2-6 and the double-channel cutter 2-7. After cleaning, turning off the feeding pump. Removing various components in sequence, placing the components in designated positions to be kept properly, and thus ending the cutting operation.

Finally, it should be noted that the above embodiments are only used for describing, rather than limiting the technical solution of the present invention. Although the present invention is described in detail with reference to the preferred embodiments, those ordinary skilled in the art shall understand that the technical solution of the present invention can be amended or equivalently replaced without departing from the purpose and the scope of the technical solution. The amendment or equivalent replacement shall be covered within the scope of the claims of the present invention.

The invention claimed is:

1. A rear-mounted double-channel abrasive jet cutting device, characterized by comprising an ultra-high pressure water jet supply system and an abrasive supply system, wherein the ultra-high pressure water jet supply system is used to provide a continuous high pressure water jet power source, abrasive transfer is provided by the abrasive supply system, and cutting is performed by a high pressure abrasive jet formed by mixing abrasive into the water jet power source, thus to enhance a hitting force for cutting; wherein the ultra-high-pressure water jet refers to a high-pressure water jet with a pressure of not less than 10 MPa;

the abrasive supply system comprises an abrasive tank and a feeding pump which are in communication with each other, a pressure cap is arranged on the abrasive tank, the abrasive tank is connected with an abrasive transfer hose, and one end of the abrasive transfer hose away from the abrasive tank is provided with an abrasive rotary sealing water swivel;

the abrasive rotary sealing water swivel comprises a water swivel outer wall, wherein the water swivel outer wall is internally divided into a water swivel high pressure water channel and a water swivel abrasive channel by a water swivel inner wall, a sealing rotary body outer bayonet is arranged on the water swivel outer wall, a sealing rotary body is arranged in the sealing rotary body outer bayonet through sealing bearings, abrasive feeding holes in communication with the water swivel abrasive channel are formed in the sealing rotary body outer bayonet, and water swivel abrasive transfer holes are formed in one end of the water swivel abrasive channel;

six abrasive feeding holes are symmetrically distributed in the water swivel inner wall.

2. The rear-mounted double-channel abrasive jet cutting device as claimed in claim 1, characterized in that: the ultra-high pressure water jet supply system comprises an ultra-high pressure clean water pump and an ultra-high pressure rotary water swivel connected by an ultra-high pressure hose; wherein the ultra-high pressure clean water pump is used to supply a high-pressure water jet with an output pressure of not less than 10 MPa; the ultra-high pressure hose and the ultra-high pressure rotary water swivel are used to convey the high-pressure water jet and have a bearing pressure commensurate with that of the high-pressure water jet.

3. The rear-mounted double-channel abrasive jet cutting device as claimed in claim 1, characterized in that: the abrasive and the water jet power source are mixed by the ultra-high pressure water jet supply system and the abrasive supply system through a double-channel sealing drill pipe; the double-channel sealing drill pipe comprises a drill pipe outer wall, and the drill pipe outer wall is internally divided into a drill pipe abrasive channel in communication with the abrasive supply system and a drill pipe high pressure water channel in communication with the ultra-high pressure water jet supply system by a drill pipe inner wall; drill pipe abrasive transfer holes are formed in one end of the drill pipe abrasive channel.

4. The rear-mounted double-channel abrasive jet cutting device as claimed in claim 1, characterized in that: cutting is performed by the ultra-high pressure water jet supply system and the abrasive supply system through a double-channel cutter, wherein the double-channel cutter comprises a cutter outer wall, and the cutter outer wall is internally divided into a cutter abrasive channel and a cutter high pressure water channel by a cutter inner wall; cutter abrasive transfer holes are formed in one end of the cutter abrasive channel, a nozzle penetrating through the cutter abrasive channel is arranged on the cutter high pressure water channel, nozzle abrasive transfer holes are formed in one end of the nozzle inside the cutter high pressure water channel, and a nozzle hole is formed in one end of the nozzle on the cutter outer wall.

5. The rear-mounted double-channel abrasive jet cutting device as claimed in claim 4, characterized in that: one end of the cutter high pressure water channel is provided with a pressure relief baffle, and the pressure relief baffle is arranged in the cutter high pressure water channel through a spring.

6. The rear-mounted double-channel abrasive jet cutting device as claimed in claim 4, characterized in that: four cutter abrasive transfer holes are annularly and symmetrically distributed at a junction between the cutter outer wall and the cutter inner wall.

7. The rear-mounted double-channel abrasive jet cutting device as claimed in claim 4, characterized in that: two nozzle abrasive transfer holes are symmetrically distributed in the nozzle.

* * * * *